US006669037B1

(12) United States Patent
Ahn

(10) Patent No.: US 6,669,037 B1
(45) Date of Patent: Dec. 30, 2003

(54) MODULAR DISPLAY RACK SYSTEM

(75) Inventor: Chong Youn Ahn, Los Angeles, CA (US)

(73) Assignee: LA Display Fixture, Inc., Los Angeles, CA (US)

( * ) Notice: Subject to any disclaimer, the term of this patent is extended or adjusted under 35 U.S.C. 154(b) by 0 days.

(21) Appl. No.: 10/117,572

(22) Filed: Apr. 4, 2002

Related U.S. Application Data

(60) Provisional application No. 60/349,940, filed on Jan. 18, 2002.

(51) Int. Cl.[7] ..... A47F 5/00

(52) U.S. Cl. ..... 211/189; 211/193; 211/190; 280/79.3

(58) Field of Search ..... 211/189, 190, 211/193, 182, 206, 103; 280/79.3

(56) References Cited

U.S. PATENT DOCUMENTS 3,212,648 A * 10/1965 Baker et al.
3,512,654 A * 5/1970 Olsen et al.
3,602,374 A * 8/1971 Alabaster
3,730,108 A * 5/1973 Stroh
3,871,784 A * 3/1975 Van Horn ..... 211/190
3,937,329 A * 2/1976 Hammerel
D327,993 S * 7/1992 Brunner
5,653,349 A * 8/1997 Dana et al. ..... 211/189
5,660,637 A * 8/1997 Dodge
5,779,065 A * 7/1998 Thalenfeld et al. ..... 211/103 X
5,887,731 A * 3/1999 Thalenfeld ..... 211/103 X
5,894,945 A * 4/1999 Curran ..... 211/206 X
6,029,833 A * 2/2000 Yeh ..... 211/189
6,129,224 A * 10/2000 Mingers ..... 211/193
6,240,687 B1 * 6/2001 Chong
6,561,366 B2 * 5/2003 Kim-So ..... 211/189
2003/0034320 A1 2/2003 Noh

* cited by examiner

*Primary Examiner*—Robert W. Gibson, Jr.
(74) *Attorney, Agent, or Firm*—Christie, Parker & Hale, LLP

(57) ABSTRACT

Modular display racks, which are easily configurable, have interchangeable components, and are capable of being packaged and shipped in small containers, are described. Preferred methods for using modular display racks are also disclosed.

20 Claims, 6 Drawing Sheets

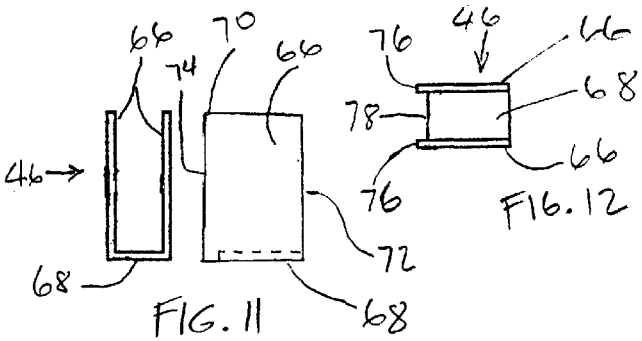
FIG. 12
FIG. 11
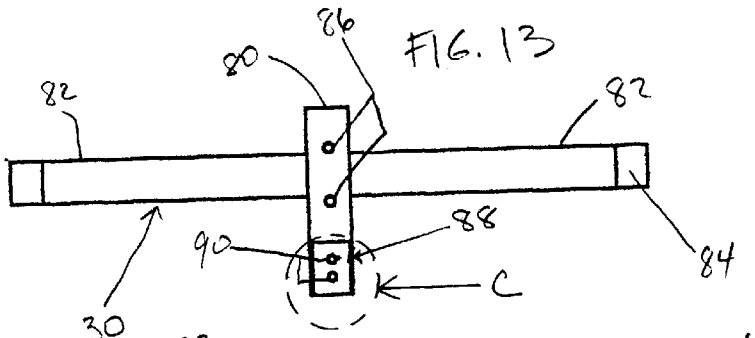
FIG. 13
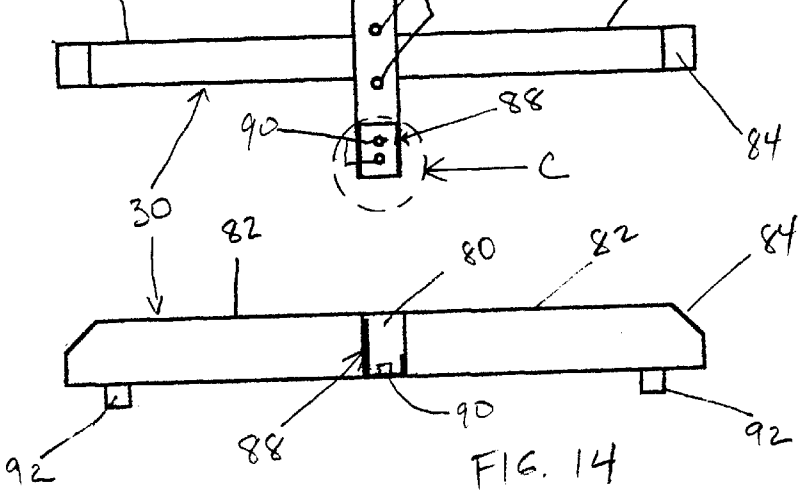
FIG. 14
FIG. 10
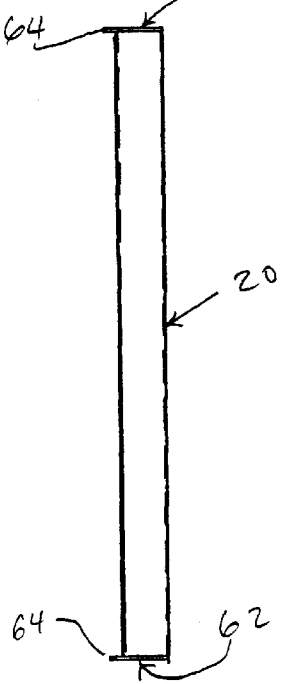
FIG. 9
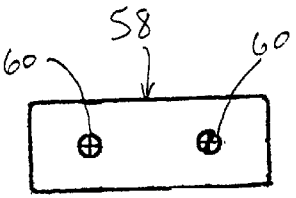
FIG. 8

MODULAR DISPLAY RACK SYSTEM

CROSS-REFERENCE TO RELATED APPLICATION

The present application claims the benefit of provisional application No. 60/349,940 entitled "MODULAR DISPLAY RACK SYSTEM" filed Jan. 18, 2002, the content of which is expressly incorporated herein by reference.

Modular display racks discussed herein generally relate to display racks for displaying merchandise items and, more specifically, to modular display racks that may be assemble and disassemble into different configurations.

BACKGROUND

Display racks having one or multiple display ladders are widely used in retail shops and departments stores to display merchandise such as clothing, toys, and food. FIG. 1 is a semi-schematic isometric drawing of a prior-art ladder style display rack. Ladder style display racks, such as that shown in FIG. 1, are generally designed to be used with hangrail brackets 11 and shelf brackets (not shown). These hangrail brackets 11 and shelf brackets (not shown) engage the individual ladder steps 2 and provide extensions (similar to a shelf or an arm) to which hangers and folded clothing may be hung or spread out for display.

There are several disadvantages with the illustrated prior art display rack 1. Among other things, the prior art display rack includes a welded upper rack portion 3 and a welded lower base portion 4. The welded upper portion 3 includes ladders 5 joined together by a plurality of lateral support bars 6. Because the joints between the lateral support bars 6 and the ladders 5 are welded, the upper portion 3 may be often quite large and heavy depending on the number of ladders used.

The base portion 4 may similarly be imposing to an individual handling and shipping the rack assembly 1. The base portion 4 includes two end stabilizer bars 7 joined together by a cross-bar 8. The end stabilizer bars 7 are usually also equipped with casters 9. Thus, packaging and finding available couriers to transport the prior art rack system 1 may be burdensome.

Another deficiency with the illustrated prior art display rack 1 is that the welded joints between the stabilizer bars 7 and the ladders 5 may sometime crack or break due to the overall weight of the rack system 1. In addition, due to the reasons discussed above, the rack system 1 may overall be heavy and difficult to manipulate. Furthermore, each configuration of the ladder rack system (i.e., a single ladder rack, a two ladder rack, a three ladder rack, and on occasions, a four ladder rack) requires separate inventory and production. This may be both expensive to produce and more difficult to minimize inventory. Among other things, several production procedures may be required for different rack configurations, making production more costly. Also, predicting which rack configuration to store may not be easy since the configuration that a customer is most likely to order may generally not be predicted. This may lead to the production and storage of multiple rack system with different configurations.

Accordingly, there remains a need for a modular display rack that is easily modifiable into different configurations. Such a modular display rack should, to the extent possible, be easier to assemble and disassemble then the display racks in the prior art.

SUMMARY

From a rack manufacturer's standpoint, display racks that are easy to assemble and disassemble have additional benefits. Racks of this type simplify inventory and are easier to package and ship via carriers such as UPS® and Federal Express®. In addition, modular racks that are capable of reducing into smaller components are easier to handle and require fewer workers and machines to manipulate. Such manipulation includes removing the components from their shelves and then packaging them for shipping.

Accordingly, the present invention utilizes detachable members to form a base and then permit individual components to removeably mount thereto to form a modular rack. To disassemble the modular rack into smaller components, the steps are simply reversed.

The modular rack can be installed as a single tower rack or as a rack of any tower size, limit only by the display area, by the addition or removal of the modular components such as the center stabilizer bars, removable cross-bars, center ladders, and lateral support bars.

The modular rack in accordance with practice of the present invention may include an upper rack portion and a lower base portion, wherein the upper rack portion includes at least two ladder racks, each ladder rack including at least one channel, the at least two ladder racks being removeably coupled to one another by a lateral support bar engaging the channel of each respective ladder rack, and wherein the lower base portion includes at least two base bars, each base bar having a center load bearing piece disposed thereon.

BRIEF DESCRIPTION OF THE DRAWINGS

FIG. 8 is a top plan view of a base bracket of detail A in FIG. 5;

FIG. 9 is a side elevation view of a lateral support bar;

FIG. 10 is a side elevation view of a flange mounted to the lateral support bar of FIG. 9;

FIG. 11 is a front and side elevation view of a U-shape bracket of detail B in FIG. 6;

FIG. 12 is a top plan view of the U-shape bracket of FIG. 11;

FIG. 13 is a top plan view of an end stabilizer bar in accordance with practice of the present invention;

FIG. 14 is a side elevation view of the end stabilizer bar of FIG. 13;

DETAILED DESCRIPTION

The detailed description set forth below in connection with the appended drawings is intended as a description of the presently preferred embodiments of the modular display rack in accordance with the present invention and is not intended to represent the only forms in which the present invention may be constructed or utilized. The description sets forth the features and the steps for constructing and using the modular display rack of the present invention in connection with the illustrated embodiments. It is to be understood, however, that the same or equivalent functions and structures may be accomplished by different embodiments that are also intended to be encompassed within the spirit and scope of the invention. Also, as denoted elsewhere herein, like element numbers are intended to indicate like or similar elements or features.

Figure 1:
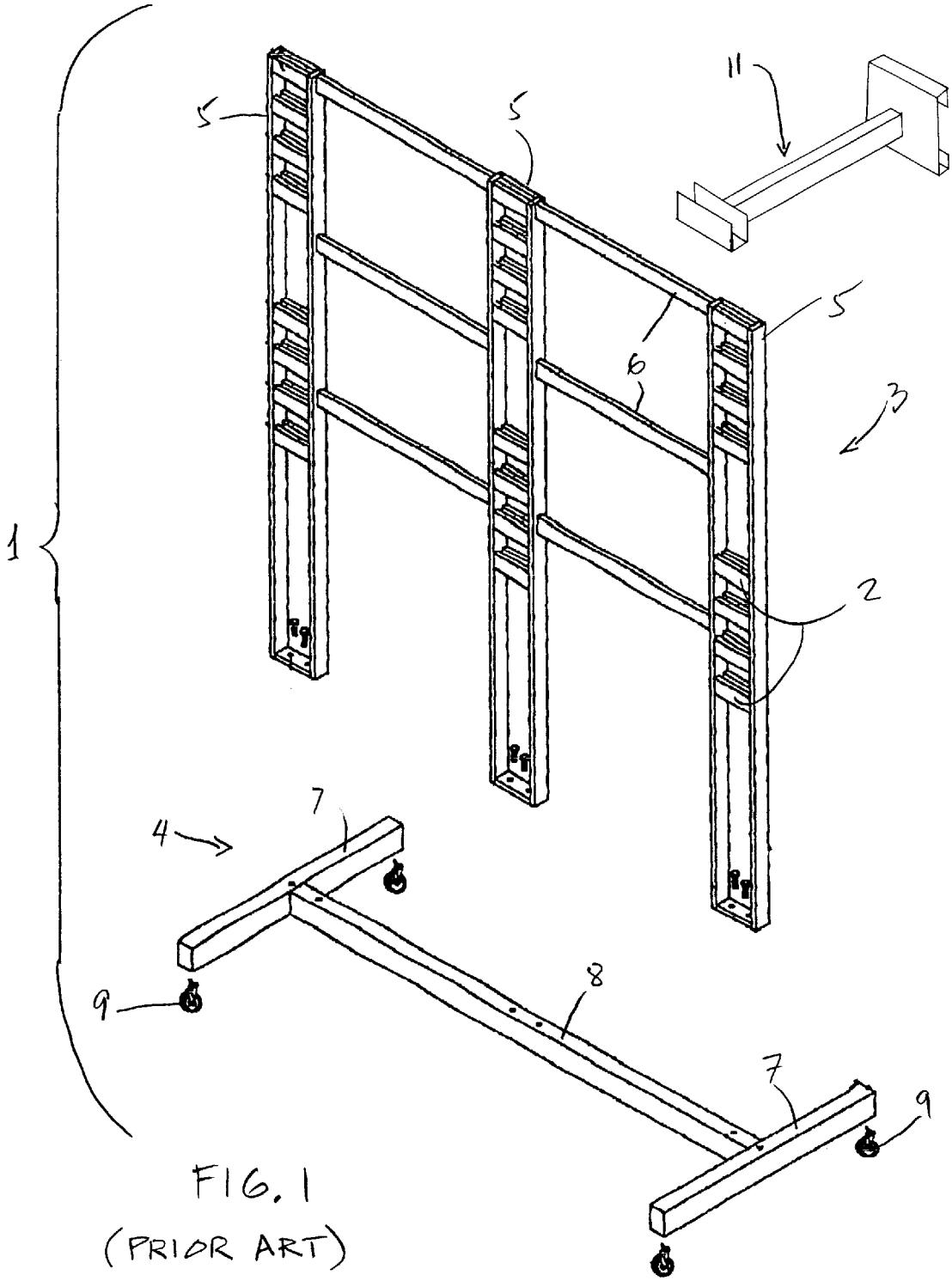
FIG. 1 (PRIOR ART)
FIG. 1 is a semi-schematic isometric drawing of a prior art display rack.
Figure 2:
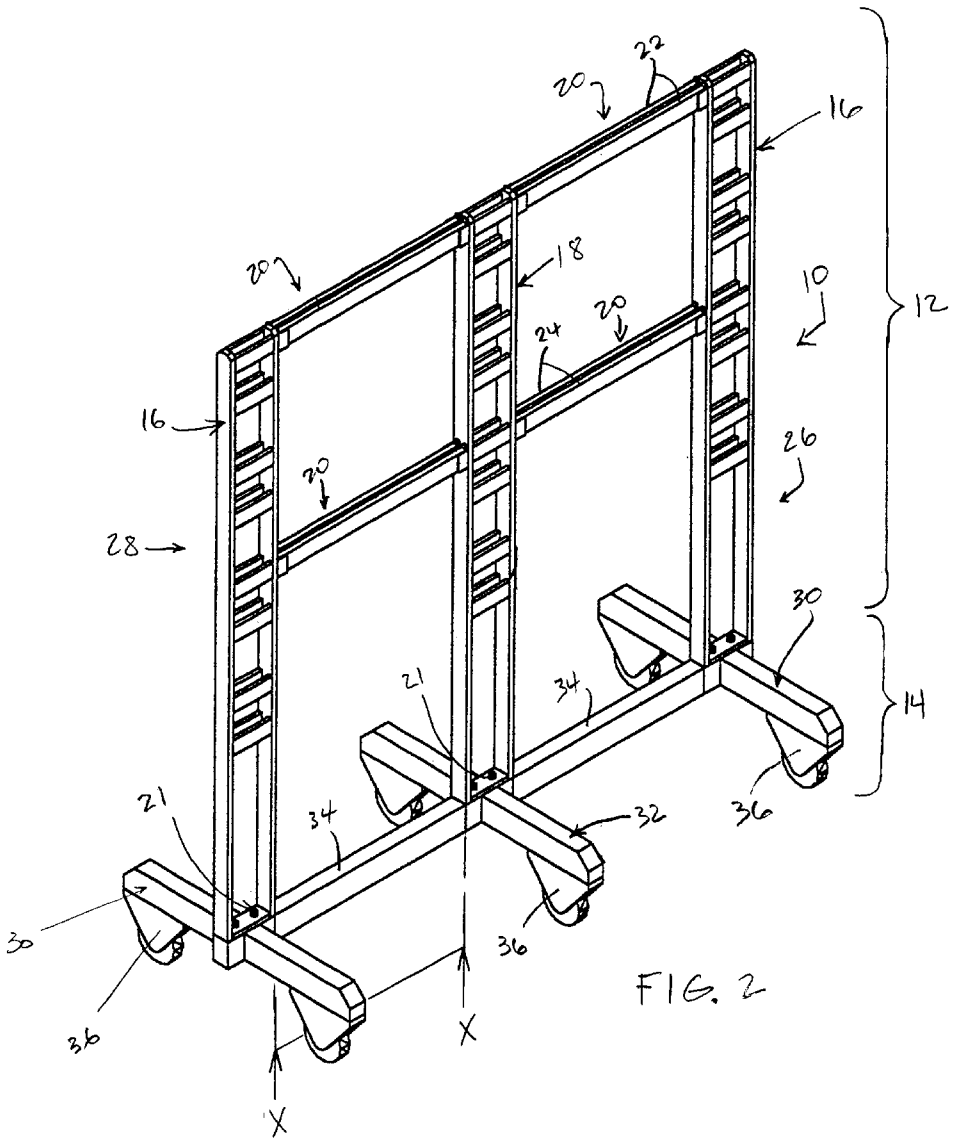
FIG. 2 is a semi-schematic isometric drawing of a modular display rack in accordance with practice of the present invention.

Referring now to FIG. 2, there is shown an embodiment of a triple tower or a three-ladder modular display rack (hereinafter "display rack"), generally designated 10. According to one embodiment, the modular display rack 10 may be disassembled into smaller components, allowing it to be portable and modular than prior art systems. The modular architecture of the display rack 10 allows it to be boxed up in small packages, assembled into a single ladder rack or multiple ladder racks, and inventoried by components instead of rack configurations since the single, double, and triple ladder racks do not have to be kept separately.

The display rack 10 according to the embodiment illustrated in FIG. 2 includes an upper rack portion 12 and a lower base portion 14. For a three-ladder rack system 10, the upper rack portion 12 includes two end ladders 16 and a center ladder 18. Assuming the vertical direction is the lengthwise direction and the horizontal direction is the direction of width of the ladder, the end and center ladders 16, 18 are interconnected by a plurality of removable lateral support bars 20 along the horizontal direction and to the base in the vertical direction, by a plurality of fasteners 21. In an exemplary embodiment, there is an upper pair of lateral support bars 22 and a lower pair of lateral support bars 24. These lateral support bars 22, 24 are removeably connected to the ladders by a detent-like arrangement. Each individual pairs of lateral support bars permit hangrail brackets 11 and shelf brackets (not shown) to be hung on either a first side 26 and/or a second side 28.

The lower base portion 14 includes two end stabilizer bars 30, a center stabilizer bar 32, and two removable cross-bars 34 used to removeably connect the two end stabilizer bars 30 with the center stabilizer bar 32. Each stabilizer bar 30, 32 is also equipped with casters 36, which may be fixed or rail type casters. However, other casters may be used such as swivel stem style casters with breaks and locks. If used, these swivel stem style casters prevent the display rack 10 from moving when pushed accidentally. The stem style casters may screw or thread directly into the stabilizer bars 30, 32, or, alternatively, thread into corresponding nuts (not shown) welded to the base of the stabilizer bars. Other casters and methods for installing the same are conventional in the art and may also be used as will be apparent to one skilled in the art.

Figure 3:
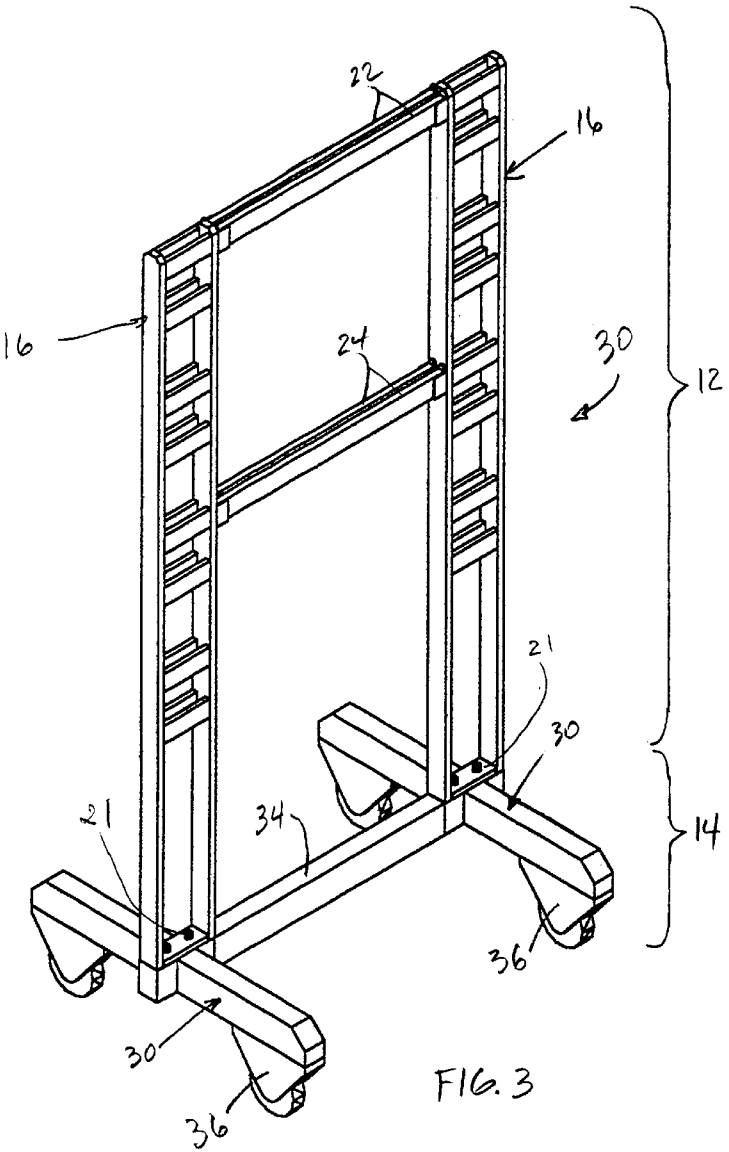
FIG. 3 is a semi-schematic isometric drawing of the modular display rack of FIG. 1 in a double ladder configuration.

Referring now to FIG. 3, there is shown a double tower or a two-ladder modular display rack 30. Like the display rack of FIG. 2, the modular display rack 30 comprises an upper rack portion 12 and a lower base portion 14. The upper rack portion 12 includes two end ladders 16 removeably secured to the base in the vertical direction by several fasteners 21. The two removable end ladders 16 are attached to each other by an upper and a lower pair of lateral support bars 22, 24.

The lower base portion 14 includes two end stabilizer bars 30 removeably secured to each other by a single cross-bar 34. The lower base portion 14 also includes a plurality of casters 36, which may be fixed or rail type casters. However, as discussed above, other casters may be used such as swivel stem style casters with breaks and locks.

As readily apparent to a person of ordinary skill in the art, the double tower display rack 30 is a subcombination of the triple tower display rack shown in FIG. 2. To create the double tower display rack 30 from the triple tower display rack 10, the center ladder 18, the two pair of lateral support bars 22, 24, the center stabilizer bar 32, and one of the removable cross-bars 34 are removed from the triple tower rack 10. Conversely, to assemble a multiple tower rack, such as a four tower rack or higher, additional center ladders 18, cross-bars 34, and lateral support bars 20, collectively referred to as rack components, are added. This eliminates the need for the advance production and storage of pre-welded multiple tower racks. Racks of different configurations may now be created via the addition or the removal of the rack components.

Figure 4:
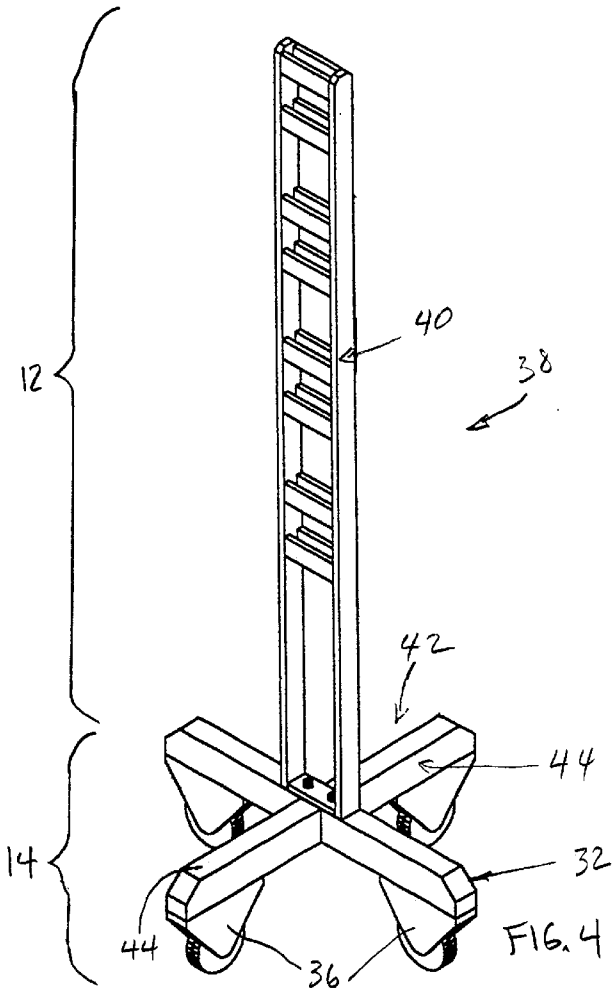
FIG. 4 is a semi-schematic isometric drawing of the modular display rack of FIG. 1 in a single ladder configuration.

Referring now to FIG. 4, there is shown and described a single tower or a single ladder display rack 38 in accordance with practice of the present invention. The single ladder display rack 38 comprises an upper rack portion 12 and a lower base portion 14. The upper rack portion 12 includes a slightly modified single unit ladder 40. It is slightly modified with respect to the end ladder 16 and the center ladder 18 of FIGS. 2 and 3. As further discussed below, the single unit ladder 40 may be similar to the end and center ladders 16, 18 except for the lack of side mounted U-shape brackets. However, for ease of inventory or the minimization of components, an end ladder 16 or a center ladder 18 may be used in place of the single unit ladder 40 to provide the same overall functionality.

The lower base portion 14 of the single ladder display rack 38 includes a single cross-style base 42. To minimize the number of different components, the cross-style base 42 may be assembled by removeably securing two half-bars 44 onto the center stabilizer bar 32. Accordingly, one component used for the single tower that may not be present in the double tower and the triple tower rack is the half-bars 44 used in the single cross-style base 42.

The cross-style base 42 also utilizes a plurality of casters 36. As discussed above, these casters may be a fixed type, a flanged type, a swivel type and the like. Accordingly, minor changes between caster types are contemplated to fall within the spirit and scope of the present invention.

Figure 5A:
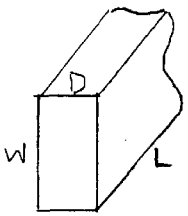
FIG. 5 is a front and side elevation view of an end ladder in accordance with practice of the present invention.
Figure 5:
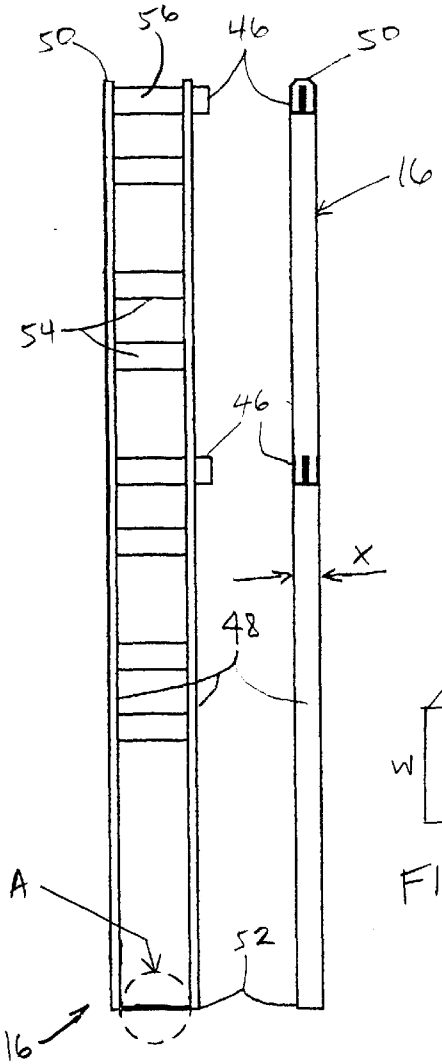

FIGS. 5–19 are now referred for a detailed description of the various components embodied in the display racks of FIGS. 2–4. Specifically, FIG. 5 is a semi-schematic diagram of the end ladder 16 of FIGS. 2 and 3. According to one embodiment of the invention, the end ladder 16 includes a pair of U-shape brackets 46. The end ladder 16 also includes a pair of vertical braces 48 taking the form of rectangular tubing pieces. The upper end 50 of each vertical brace 48 may be machined, rolled, or extruded (collectively "machined") with a smooth finish for aesthetic appeal and for eliminating sharp edges. This upper end 50 may be shaped in a half-dome, half arrow, or any other shapes helping to eliminate sharp edges and providing a minimum aesthetic appeal. The lower end 52, because it braces onto a stabilizer bar, is machined with a flat finish.

The pair of vertical braces 48 is fixedly secured together by a plurality of cross-braces 54. The number of cross-braces in the ladder 16 depends on the length of the ladder. The vertical braces 48 and the cross braces 54 have the following configuration: L×W×D, where L is the length, W is the width, and D is the depth of the rectangular tubing (FIG. 5A). In an embodiment where each vertical brace 48 has a width X, each of the cross-braces 54, which may also be made from rectangular tubing pieces, have a depth that is less than half X. This provides, at each cross-brace to vertical brace welded location, space for accommodating a pair of cross-braces 54. In other words, at the top cross-brace location 56, two cross-braces 54, one superimposed over the other but separated by a small gap, are welded to the pair of vertical braces 48. Thus, two times the depth of the cross-brace plus the small gap should be the same as or slightly less than the width of the vertical brace 48. Exemplary dimensions are further discussed below.

Figure 6:
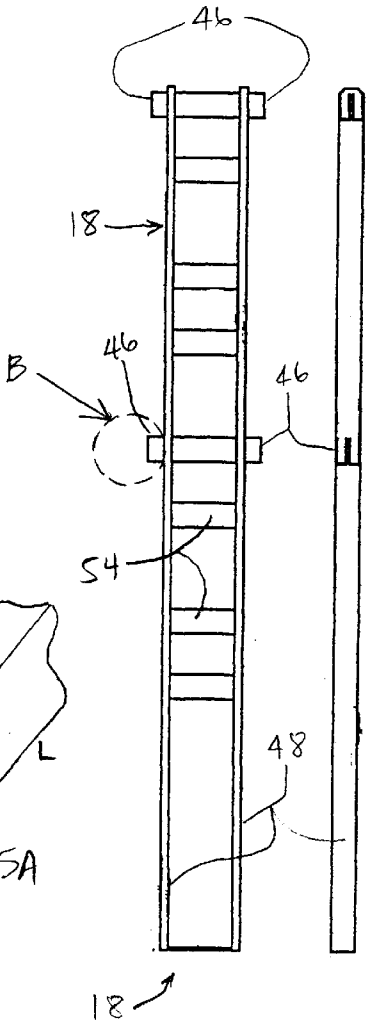
FIG. 6 is a front and side elevation view of a center ladder in accordance with practice of the present invention.

Referring now to FIG. 6, there is shown and described a center ladder 18 in accordance with practice of the present invention. The center ladder 18 may be similar to the end ladder 16 except that the center ladder includes two sets of U-shape brackets 46 on each side of the vertical brace 48. This allows the center brace 18 to be used in the center of any multiple ladder arrangements and be used to join adjacent ladders together by way of removeably securing lateral support bars to the U-shape brackets 46.

Figure 7:
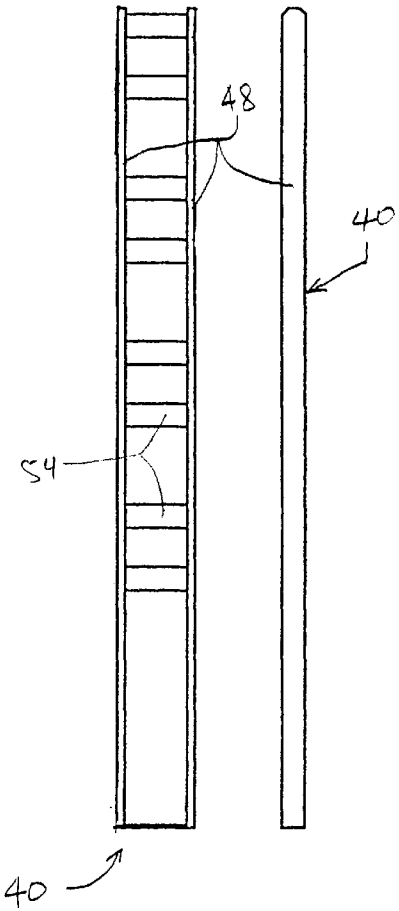
FIG. 7 is a front and side elevation view of a single unit ladder in accordance with practice of the present invention.

Referring now to FIG. 7, a single unit ladder 40 is shown and described. The single unit ladder 40 may be similar to the end ladder except for the lack of U-shape brackets welded to the vertical braces 48. The U-shape brackets are not included in the single unit ladder 40 since it is used as a stand-alone tower rack, and not contemplated to be expanded into other configurations.

Although the end, center, and single unit ladders of FIGS. 5, 6, and 7 are shown having a particular dimension with a particular number of cross-braces, a person skilled in the art should recognize that alternative dimensions and alternative number of cross-braces may also be used. The dimensions and number of cross-braces may also be customizable based on needs and requests of merchants and customers. Similarly, instead of welding a pair of cross-braces at each of the cross-brace to vertical brace location or using a U-shape bracket (for allowing hangrail brackets 11 and shelf brackets (not shown) to be mounted on either a first side 26 and/or a second side 28 of the rack), a single cross-brace and/or a single U-shape bracket may be used. If so, for a particular attachment location, only a single hangrail, a single shelf bracket, or a single removable lateral support bar may be used.

Referring now to FIG. 8, there is shown and described a base bracket 58, which is a blown up view of detail A indicated in FIG. 5. According to one embodiment, the base bracket 58 is a flat steel plate having two through holes 60 machined therein. The base bracket 58 is fixedly secured to the vertical braces 48 by any number of known welding methods, including arc welding, brazing, and resistance welding. The two through holes 60 allow a pair of fasteners 21 to be inserted therethrough and to tighten the ladder against a stabilizer bar such as, stabilizer 30 or 32. It is understood that any number of welding methods apply whenever the term "weld", "welded", or "welding" is used.

Referring to FIGS. 9 and 10, there is shown and described an exemplary lateral support bar 20, which can be the upper 22 or the lower lateral support bar 24. The lateral support bar can be made from a rectangular tubing piece and is welded on each end by a flange 62. The flange 62 includes an engagement tip 64 configured to engage a U-shape bracket 46 in a detent-like fashion. The flange 62 may be made from a flat steel plate.

Referring now to FIGS. 11 and 12, there is shown and described an exemplary U-shape bracket 46, which is a blown up view of detail B indicated in FIG. 6. According to one embodiment, the U-shape bracket 46 is a steel channel having two sides 66 and a base 68. Each of the two sides 66 comprises a square finish 70 or a rounded finish, a first open face 72, and a rear attachment face 74. The open face 72 allows a lateral support bar 20, when set in position, to slide in-between the two sides 66 and rest on top of the base 68. Conversely, the rear attachment face 74 is configured to be welded to a main vertical brace 48 by its two end surfaces 76 (FIG. 12). As indicated, the base 68 terminates short of the rear attachment face 74 to form a receiving channel 78. Accordingly, when a lateral support bar 20 is set in position inside the U-shape bracket 46, the receiving channel 78 provides an opening or a gap for the engagement tip 64 located on the flange 62, which, as discussed, is located on each of the ends of the lateral support bar 20 (FIG. 9). Accordingly, the engagement tip 64 and the receiving channel 78 interact to removeably secure one ladder with another ladder (such as securing one end ladder 16 to a center ladder 18).

In an exemplary embodiment, two U-shape brackets 46 are welded, side-by-side, to the main vertical brace 48. In this fashion, the two U-shape brackets 48 may accommodate two lateral support bars 20 in a side-by-side fashion to provide two hanging surfaces for hangrails 11 and the like. In order to allow sufficient space for the engagement end of the hangrail to engage the lateral support bar 20, the two U-shape brackets 46 may be welded with a flat plate (not shown) disposed therebetween. According to one embodiment, this plate serves to not only add structural rigidity to the two U-shape brackets, but also fix or define a gap in-between the U-shape brackets to enable the engagement end of the hangrail 11 to grab onto.

Referring now to FIGS. 13 and 14, there is shown and described an end stabilizer bar 30, also referred to as a base bar, in accordance with practice of the present invention. The end stabilizer bar 30 includes two leg extension pieces 82 welded to a center load-bearing piece 80. Again, all three pieces, the two leg extension pieces 82 and the center load-bearing piece 80, may be made from rectangular tubing. In an exemplary embodiment, at the end 84 of each leg extension 82, a tapered or slanted finish 84 is provided. This serves to both beautify the ends of the stabilizer bar 30 and eliminate sharp edges.

In the illustrated embodiment, the center load-bearing piece 80 includes two through holes 86. These through holes 86, which extend the entire width of the center load bearing piece, are positioned so that when an end ladder 16 is mounted to the end stabilizer bar 30 by, for example, positioning the base bracket 58 directly over the center load bearing piece 80, the through holes 86 align with the through holes 60 on the base bracket 58. After the through holes 60, 86 are aligned, a pair of fasteners 21, such as a pair of bolt and nut combination, may be inserted therethrough and tightened. A person skilled in the art should recognize that any other number of through holes may be used depending on the width of the center load bearing piece and the dimension of the holes.

A joining bracket 88 is provided which is welded to one of the axial ends of the center load-bearing piece 80. A pair of nuts 90 are also provided and welded onto the joining bracket 88 to serve as gripping points for a pair of bolts (not shown). Thus, to join two end stabilizer bars 30 (or one end stabilizer bar 30 and one center stabilizer bar 32) together, a removable cross-bar 34 is placed over the joining bracket 88 in a telescoping fashion. A pair of bolts (not shown) are then inserted and tightened against the pair of nuts 90 to thereby removeably secure the cross-bar 34 to the end stabilizer bar 30. As discussed above, the lower base portion 14 may be practiced with swivel type casters. When that is the case, the two leg extensions 82 are fitted or welded with a pair of swivel nuts 92. The swivel type casters can then thread or screw directly into the swivel nuts 92 to be removeably secured the casters thereto.

Figure 16:
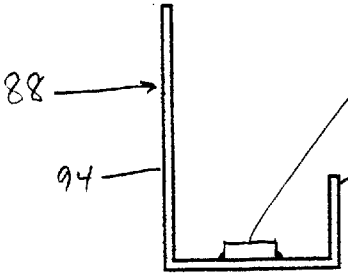
FIG. 16 is a side elevation view of the joining bracket of FIG. 15.
Figure 15:
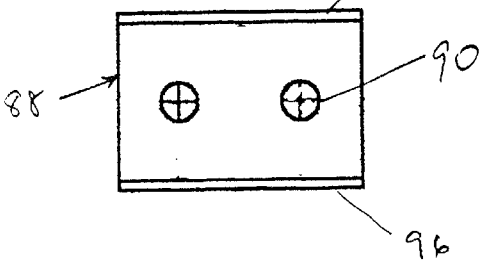
FIG. 15 is a top plan view of a joining bracket of detail C in FIG. 13.

Referring now to FIGS. 15 and 16, there is shown and described the joining bracket 88 discussed in reference with FIGS. 13 and 14, which are blown up drawings of detail C in FIG. 13. In the illustrated embodiment, the joining bracket 88 is an extended L-shape bracket that includes a first tall side 94 and a second short side 96. The second short side 96 allows access to the central portion where the nuts 90 can be welded to the bracket. In addition, because the joining bracket 88 is designed to fit into one of the ends of a removable cross-bar 34 in a telescoping fashion, the second shorter side 96 has the effect of reducing drag or friction as the removable cross-bar 34 engages the joining bracket 88. Thus, because of the telescoping style arrangement, it is understood that the joining bracket 88 has a smaller cross-sectional area than the cross-sectional area of the cross-bar. A person skilled in the art should recognize, however, that instead of a tall side and a short side, two tall sides may be used to render a U-shape bracket.

Figure 17:
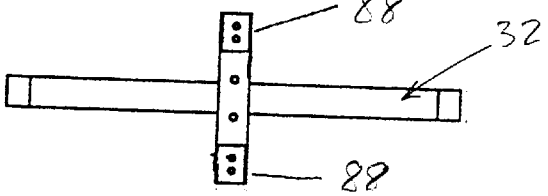
FIG. 17 is a top plan view of a center stabilizer bar in accordance with practice of the present invention.

Referring now to FIG. 17, there shown and described a top plan view of the center stabilizer bar 32 of FIG. 2. The center stabilizer bar 32 may be similar to the end stabilizer bar 30 except that the center stabilizer bar includes two joining brackets 88 instead of one. This enables the center stabilizer bar 32 to be used in-between two end stabilizer bars 30 and be connected on each side by a removable cross-bar 34.

Figure 18:
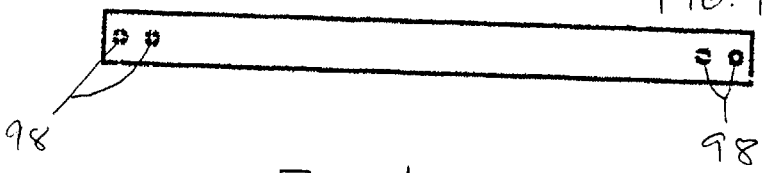
FIG. 18 is a bottom plan view of a removable cross-bar of FIG. 2 taken at line 18—18.

Referring now to FIG. 18, there is shown and described a removable cross-bar 34 taken along reference line X—X of FIG. 2. According to one embodiment, the removable cross-bar 34 is made from rectangular tubing and is drilled on both ends with a pair of holes 98. The holes are configured so that they align with the pair of nuts 90 welded to the joining bracket 88 (FIG. 15). Accordingly, when the removable cross-bar 34 is slid over the joining bracket 88 in a telescoping fashion, the holes 98 align with the nuts 90 on the joining bracket 88. In this fashion, a pair of bolts may then be inserted to removeably secure the cross-bar 34 with one of the end stabilizer bars 30 or one of the center stabilizer bars 32.

Figure 19:
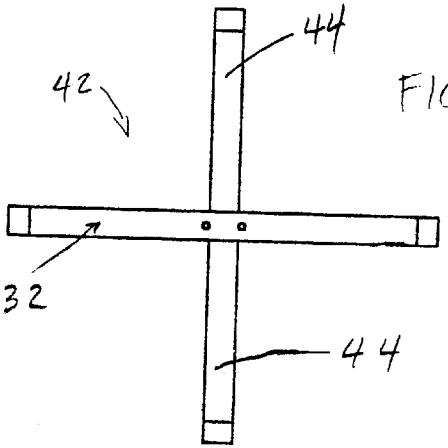
FIG. 19 is a top plan view of a cross-style base of FIG. 4.

Referring now to FIG. 19, there is shown and described a top plan view of the cross-style base 42 of FIG. 4. The cross-style base 42 may be a center stabilizer bar 32 with two half-bars 44 mounted in a telescoping fashion with the two joining brackets 88. Alternatively, the joining brackets 88 may be eliminated altogether by welding two half-bars 44 directly onto the center stabilizer bar 32. This alternative method will produce a cross-style base 42 that is permanently fixed.

In general terms, a multi-tower rack may be assembled in the following fashion with reference to FIGS. 2–4. In assembling the lower base portion 14, two end stabilizer bars 30 are fastened with one center stabilizer bar 32 for creating a three-tower rack. A cross-bar 34 is slid over the joining bracket 88 of the end stabilizer bar 30 and tightened with a pair of bolts at the cross-bar holes 98. The other end of the cross-bar 34 is then slid over the joining bracket 88 of the center stabilizer bar 30 and then tightened with another pair of bolts. This is then repeated on the other side with another end stabilizer bar 30 and another cross-bar 34 to form the base. After the lower base portion 14 is assembled, it may be disassembled by reversing the steps.

In assembling the upper rack portion 12, two end ladders 16 are fastened on the two end stabilizer bars 30 by inserting a pair of bolts at the base bracket 58 through the through holes 86 of each end ladder 16. The U-shape brackets 46 on each of the end ladders 16 are turned so that they face inward, toward the center stabilizer bar 32. In the same fashion, a center ladder 18 is mounted over the center stabilizer bar 32. Eight lateral support bars 20 are then used to removeably secure the two end ladders 16 with the center ladder 18. This is done by lowering the flange ends 62 of the lateral support bars into corresponding pair of U-shape brackets 46. The engagement tips 64 of the various flanges 62 should slide into their respective receiving channels 78. Once the upper rack portion 12 is assembled, it may be disassembled by reversing the steps.

Listed below are exemplary rectangular tubing and bracket dimensions. However, it is understood that these are exemplary only and that other dimensions, thickness, etc. may be altered without changing the scope of the invention. Accordingly, a mere change in size or dimension is contemplated within the present invention.

- Main vertical brace 48—1338 mm L×38 mm W×12.7 mm D
- Cross-brace 54—102 mm L×34 mm W×12.7 mm D
- Base bracket 58—4" L×1.5" W×1/16"–1/8" thick
- U-shape bracket 46—25.4 mm L×40 mm W×17.2 mm D×2 mm thick
- Lateral support bar 20—508 mm L×35.6 mm W×12.7 mm D
- Flange 62—47.6 mm L×12.7 mm W×1/16" to 1/8" thick
- Extended L-shape bracket 88—50.8 mm L×54.5 mm W (tall side)×36.6 mm D×19 mm W (short side)×1/16" to 1/8" thick
- Leg extension piece 82—282.5 mm L×60.2 mm W×40.6 mm D
- Center load bearing piece 80—127 mm L×60.2 mm W×406 mm D
- Tubing can have a range of 11–20 gauge, and where necessary 3/16" or even 1/4"

Although the preferred embodiments of the invention have been described with some specificity, the description and drawings set forth herein are not intended to be delimiting, and persons of ordinary skill in the art will understand that various modifications may be made to the embodiments discussed herein without departing from the scope of the invention, and all such changes and modifications are intended to be encompassed within the appended claims. Various changes to the modular display rack may be made including manufacturing the entire rack out of square tubing, changing the dimension of the tubing pieces, adding more or fewer cross-braces and U-shape brackets, changing the metallurgy, changing the finish (from nickel to grinded steel finish or brush steel finish), and changing the type of casters. Accordingly, many alterations and modifications may be made by those having ordinary skill in the art without deviating from the spirit and scope of the invention.

What is claimed is:

1. A modular display rack comprising an upper rack portion and a lower base portion, wherein said upper rack portion comprises at least two ladder racks, each ladder rack including at least one receiving channel comprising a base and two sides, and an open receiving slot, the at least two ladder racks being removeably coupled to one another by a lateral support bar resting in between the two sides and engaging the open receiving slot of the receiving channel of each respective ladder rack, and wherein said lower base portion comprises at least two base bars, each base bar having two ends and a center load bearing piece disposed thereon in between the two ends, and wherein the load bearing piece comprises a section that is perpendicular to a section of the base bar.

2. The modular display rack of claim 1, further comprising a center base bar and a center ladder rack, said center base bar being removeably coupled to said at least two base bars, and said center ladder rack being removeably coupled to said at least two ladder racks.

3. The modular display rack of claim 1, further comprising at least one of a swivel type caster or a flange type caster attached to an underside of one of the at least two base bars.

4. The modular display rack of claim 1, wherein the two sides and the base of the receiving channel comprises a U-shape bracket, said U-shape bracket having a base and two sides, said base further comprising, an edge and said two sides further comprising two edges, wherein the three edges do not all terminate along a same plane to form the open receiving slot.

5. The modular display rack of claim 1, wherein the at least two ladder racks further include two receiving channel locations, wherein each channel location including two receiving channels separated from one another by a plate.

6. The modular display rack of claim 1, wherein the at least two ladder racks further include two channel receiving locations, each channel receiving location including a single receiving channel.

7. The modular display rack of claim 1, further comprising two center ladders and two center base bars, said two center ladders and said two center base bars are removeably connected to said at least two ladders racks and said at least two base bars to form a four tower display rack.

8. The modular display rack of claim 1, wherein the at least two ladder racks and the at least two base bars are made from rectangular tubing pieces and wherein a rectangular tubing piece that makes up a portion of one of the at least two base bars is mounted so that the width of the rectangular tubing piece is in a vertical position.

9. A display rack comprising:

an upper rack portion comprising a first end ladder rack and a second end ladder rack and a lower base portion comprising a first end stabilizer bar and a second end stabilizer bar, wherein the first and the second end ladder racks are mechanically coupled to one another when a first lateral support bar comprising two male tabs each engages a slot in a receiving channel positioned on each of the first and the second end ladder racks, and the first and the second end stabilizer bars are mechanically coupled to one another when a cross-bar is telescopically positioned over a joining bracket located on a side edge of each of the first and the second end stabilizer bars, said display rack being configured to expand in size when a center ladder rack is positioned in between the first and the second end ladder racks and a center stabilizer bar is positioned between the first and the second end stabilizer bars;

wherein when the display rack is expanded, the lateral support bar is positioned in between either the first end ladder rack and the center ladder rack or between the second end ladder rack and the center ladder rack, and wherein a second lateral support bar is positioned between either the first end ladder rack and the center ladder rack or between the second end ladder rack and the center ladder rack.

10. The display rack of claim 9, further comprising a center stabilizer bar positioned between the first end stabilizer bar and the second end stabilizer bar and the center ladder rack is positioned over the center stabilizer bar.

11. The display rack of claim 9, wherein the center ladder rack, the first end ladder rack, and the second end ladder rack each having two receiving channel locations; and wherein each receiving channel location including two U-shape brackets separated by a plate.

12. The display rack of claim 9, wherein the first and the second lateral support bars each includes two male tabs, and wherein the male tabs each comprises a protruding edge for engaging the slot of the receiving channel.

13. The display rack of claim 9, wherein the center ladder rack, the first end ladder rack, and the second end ladder rack each includes two receiving channel locations, and wherein each receiving channel location includes at least one U-shape bracket welded thereto.

14. The display rack of claim 9, further comprising a caster positioned on an underside of the first, the second, and the center stabilizer bars.

15. A method for installing a modular display rack, said method comprising:

a) coupling a removable cross-bar having two open ends to two joining brackets, the two joining brackets being individually attached to two different stabilizer bars;

b) fastening a ladder rack to each of the stabilizer bars at a center load bearing piece of each stabilizer bar;

c) removeably coupling the two ladders to each other via a lateral support bar engaging a receiving channel located on each ladder rack; and d) wherein the receiving channels each comprises two sides and a base, and wherein the lateral support bar rests on the base between the two sides of each receiving channel in engaging the two receiving channels.

16. The method of claim 15, wherein the lateral support bar comprises two protruding ends for engaging the two receiving channels.

17. The method of claim 15, wherein the two sides each comprises an edge and the base comprises an edge and wherein the three edges do not all terminate along a same plane to form an open receiving slot.

18. The method of claim 15, wherein the two stabilizer bars are connected to one another in a telescoping fashion with the cross-bar and the two ladder racks are connected to the two stabilizer bars by fasteners.

19. A modular display rack comprising a plurality of removable components including:

a first ladder rack including a first side having a first bracket;

a second ladder rack having a second bracket;

a first base bar having a first edge and a first load-bearing piece for removeably supporting the first ladder rack in an upright position, the first load-bearing piece including a second edge and a third bracket, wherein the first edge and the second edge are in a generally perpendicular configuration relative to one another;

a second base bar having a third edge and a second load-bearing piece for removeably supporting the second ladder rack in an upright position, the second load-bearing piece including a fourth edge and a fourth bracket, wherein the third edge and the fourth edge are in a generally perpendicular configuration relative to one another;

a first lateral bar disposed between the first ladder rack and the second ladder rack, the first lateral bar having first and second ends for removeably engaging the first bracket and the second bracket of the first and second ladder racks respectively;

a first cross bar disposed between the first base bar and the second base bar, the first cross bar having third and fourth ends for removeably engaging the third and fourth brackets of the first and second load bearing pieces respectively;

wherein, the modular display rack may be assembled or disassembled into different configurations by engaging or disengaging the removable components.

20. The modular display rack of claim 19, wherein the first bracket and the second bracket located on the first ladder rack and the second ladder rack, respectively, each comprises two sides and a base, wherein the two sides each comprises an edge and the base comprises an edge, and wherein the three edges do not terminate on a same plane to form a receiving slot.

* * * * *